US011749946B2

(12) United States Patent
Asano

(10) Patent No.: US 11,749,946 B2
(45) Date of Patent: Sep. 5, 2023

(54) CONNECTOR WITH BOOSTER MECHANISM

(71) Applicants: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

(72) Inventor: Yasunori Asano, Mie (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 249 days.

(21) Appl. No.: 17/418,832

(22) PCT Filed: Jan. 7, 2020

(86) PCT No.: PCT/JP2020/000098
§ 371 (c)(1),
(2) Date: Jun. 27, 2021

(87) PCT Pub. No.: WO2020/145246
PCT Pub. Date: Jul. 16, 2020

(65) Prior Publication Data

US 2022/0077630 A1 Mar. 10, 2022

(30) Foreign Application Priority Data

Jan. 10, 2019 (JP) ..... 2019-002434

(51) Int. Cl.
*H01R 13/629* (2006.01)
*H01R 13/631* (2006.01)

(52) U.S. Cl.
CPC . *H01R 13/62944* (2013.01); *H01R 13/62977* (2013.01); *H01R 13/631* (2013.01)

(58) Field of Classification Search
CPC ..... H01R 13/62911; H01R 13/62916; H01R 13/62922; H01R 13/62944; H01R 13/62977; H01R 13/631
(Continued)

(56) References Cited

U.S. PATENT DOCUMENTS 5,110,301 A 5/1992 Inoue et al.
5,873,745 A * 2/1999 Duclos ..... H01R 13/62944 439/372
(Continued)

FOREIGN PATENT DOCUMENTS

EP 3232518 A1 * 10/2017 ..... H01R 13/62944
JP H04-121677 U 10/1992
(Continued)

OTHER PUBLICATIONS

International Search Report dated Mar. 3, 2020 for WO 2020/145246 A1 (5 pages).

*Primary Examiner* — Marcus E Harcum
(74) *Attorney, Agent, or Firm* — Venjuris, P.C.

(57) ABSTRACT

A connector with booster mechanism includes a housing, an operation lever rotatably mounted on the housing and including an arm portion, a drive gear integrally rotatably provided on the operation lever, a speed-reduction member rotatably mounted on the housing, and a slider. The drive gear is coaxial with a rotation center shaft and disposed at a position different from the arm portion in an axial direction of the rotation center shaft. The speed-reduction member includes a large-diameter gear to be meshed with the drive gear and a small-diameter gear having a smaller diameter than the large-diameter gear and coaxial with the large-diameter gear. The slider includes a rack to be meshed with
(Continued)

the small-diameter gear and is mounted on the housing movably in a direction intersecting a connecting direction to a mating connector.

5 Claims, 6 Drawing Sheets

(58) Field of Classification Search
USPC ..... 439/752, 157, 372
See application file for complete search history.

(56) References Cited

U.S. PATENT DOCUMENTS 5,928,012 A * 7/1999 Kitamura ..... H01R 13/62977 439/157
5,982,637 A * 11/1999 Noguchi ..... B60R 11/02 361/600
6,682,157 B2 * 1/2004 Ito ..... B60R 11/0235 312/319.2
6,685,489 B1 * 2/2004 Rubenstein ..... H01R 12/7005 439/157
7,441,738 B2 * 10/2008 Kim ..... B60R 11/0235 345/110
7,568,925 B2 * 8/2009 Ciriello ..... H01R 13/62977 439/157
7,695,296 B1 * 4/2010 Hitchcock ..... H01R 13/62922 439/372
7,704,086 B2 * 4/2010 Gimbel ..... H01R 13/74 439/372
8,007,298 B2 * 8/2011 Komiyama ..... H01R 13/4361 439/157
8,197,270 B2 * 6/2012 Vasbinder ..... H01R 13/62977 439/157
10,218,118 B2 * 2/2019 Mito ..... H01R 13/62927
10,276,977 B2 * 4/2019 Lesniak ..... H01R 13/6295
10,374,356 B2 * 8/2019 Amerio ..... H01R 13/62955
10,511,125 B2 * 12/2019 Shindo ..... H01R 13/62938
2002/0025712 A1 * 2/2002 Mochizuki ..... H01R 13/62972 439/357
2005/0064749 A1 * 3/2005 Stella ..... H01R 13/62927 439/157
2009/0246991 A1 * 10/2009 Shuey ..... H01R 13/62944 439/157
2011/0034049 A1 * 2/2011 Shishikura ..... H01R 13/62955 439/157
2014/0273566 A1 * 9/2014 Allgood ..... H01R 13/516 439/157
2016/0149342 A1 * 5/2016 Rodriguez ..... H01R 13/62922 439/157
2017/0279215 A1 * 9/2017 Shibaya ..... H01R 13/62977
2020/0014146 A1 * 1/2020 Aoshima ..... H01R 13/6275

FOREIGN PATENT DOCUMENTS

JP H06-073879 U 10/1994
JP H06-076879 U 10/1994
JP 2011-243322 A 12/2011

* cited by examiner

CONNECTOR WITH BOOSTER MECHANISM

CROSS REFERENCE TO RELATED APPLICATIONS

This application is a national phase of PCT application No. PCT/JP2020/000098, filed on 7 Jan. 2020, which claims priority from Japanese patent application No. 2019-002434, filed on 10 Jan. 2019, all of which are incorporated herein by reference.

TECHNICAL FIELD

The present disclosure relates to a connector with booster mechanism.

BACKGROUND

Patent Document 1 discloses such a connector with booster mechanism that an operation lever, a double gear and a rack are mounted on a female housing and a rotational operation force of the operation lever is transmitted to the rack via the double gear. A partial gear of the operation lever is meshed with a large gear of the double gear, and a small gear of the double gear is meshed with a pinion (linear teeth) of the rack. The rotational operation force applied to an arm of the operation lever is increased by the mesh of these gears to become a drive force for sliding the rack.

PRIOR ART DOCUMENT

Patent Document

Patent Document 1: JP H06-076879 A

SUMMARY OF THE INVENTION

Problems to be Solved

In the above connector, the arm and the partial gear of the operation lever are arranged at the same position in a center of rotation of the operation lever and an axial direction of the partial gear, and the large gear meshed with the partial gear is also at the same position as the arm in the axial direction. Thus, an allowable rotation angle of the arm is limited to a range free from interference with the large gear. To obtain desired boosting performance under a condition that the allowable rotation angle of the arm is limited, it is necessary to ensure a necessary rotation angle of the double gear by increasing a pitch diameter of the partial gear. If the pitch diameter of the partial gear is increased, the arm of the operation lever needs to be extended by that much to avoid an increase of a necessary operation force. If the arm of the operation lever is extended, the connector is enlarged.

A connector with booster mechanism of the present disclosure was completed on the basis of the above situation and is designed for miniaturization.

Means to Solve the Problem

The present disclosure is directed to a connector with booster mechanism, the connector including a housing, an operation lever rotatably mounted on the housing, the operation lever including an arm portion radially extending from a rotation center shaft, a drive gear integrally rotatably provided on the operation lever, a speed-reduction member rotatably mounted on the housing, and a slider, wherein the drive gear is coaxial with the rotation center shaft and disposed at a position different from the arm portion in an axial direction of the rotation center shaft, the speed-reduction member includes a large-diameter gear to be meshed with the drive gear and a small-diameter gear having a smaller diameter than the large-diameter gear and disposed coaxially with the large-diameter gear, and the slider includes a cam groove and a rack to be meshed with the small-diameter gear and is mounted on the housing movably in a direction intersecting a connecting direction to a mating connector.

Effect of the Invention

According to the present disclosure, miniaturization is possible.

DETAILED DESCRIPTION TO EXECUTE THE INVENTION

Description Of Embodiments Of Present Disclosure

Figure 1:
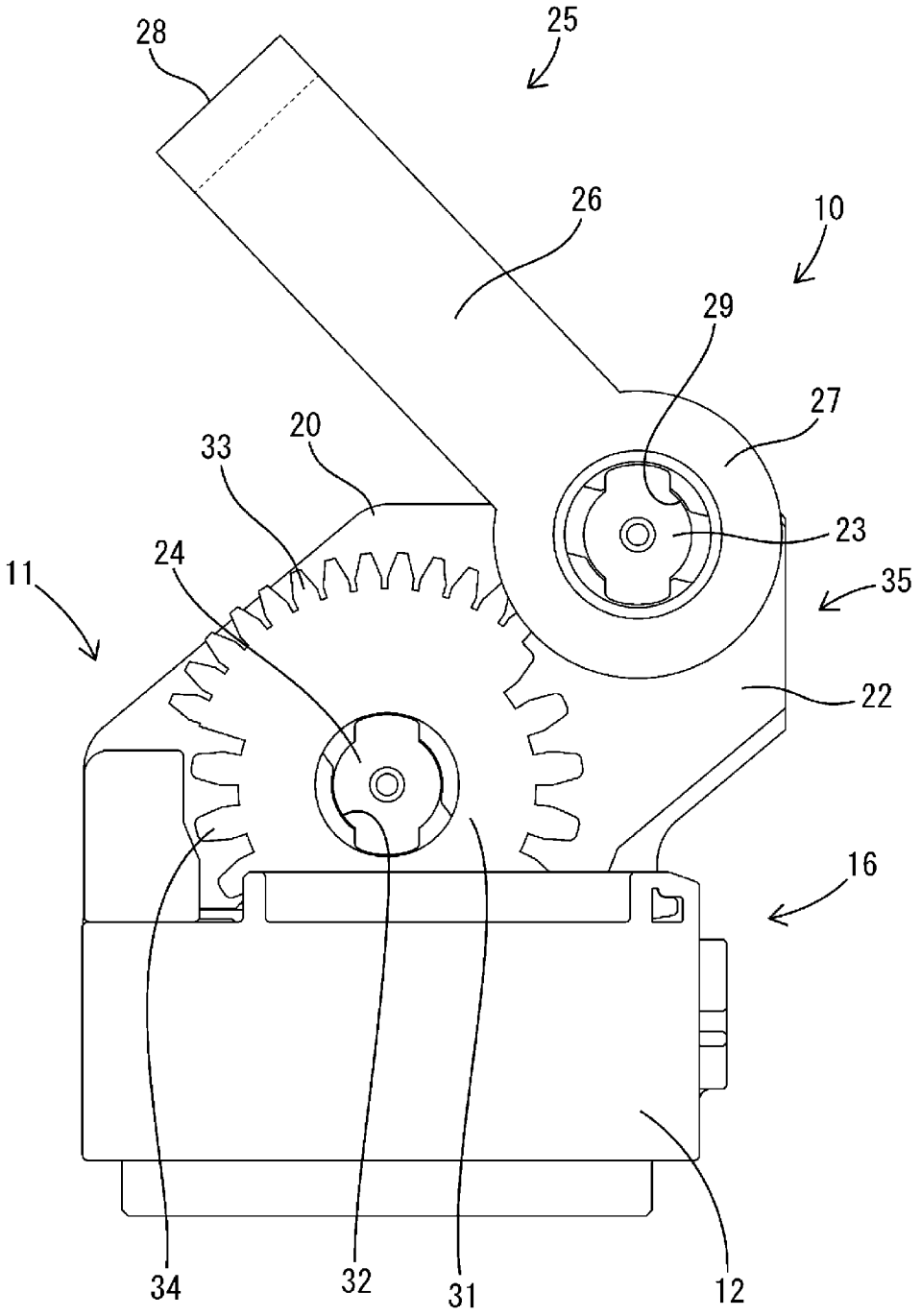
FIG. 1 is a side view of a first connector of one embodiment.

First, embodiments of the present disclosure are listed and described.

(1) The connector with booster mechanism of the present disclosure includes a housing, an operation lever rotatably mounted on the housing, the operation lever including an arm portion radially extending from a rotation center shaft, a drive gear integrally rotatably provided on the operation lever, a speed-reduction member rotatably mounted on the housing, and a slider, wherein the drive gear is coaxial with the rotation center shaft and disposed at a position different from the arm portion in an axial direction of the rotation center shaft, the speed-reduction member includes a large-diameter gear to be meshed with the drive gear and a small-diameter gear having a smaller diameter than the large-diameter gear and disposed coaxially with the large-diameter gear, and the slider includes a cam groove and a rack to be meshed with the small-diameter gear and is mounted on the housing movably in a direction intersecting a connecting direction to a mating connector.

According to the configuration of the present disclosure, since the arm portion of the operation lever and the large-diameter gear of the speed-reduction member are shifted in position from each other in the axial direction of the rotation center shaft of the operation lever, there is no possibility that the arm portion interferes with the large-diameter gear even if an angle of rotation of the operation lever is increased. According to the present invention, since the angle of rotation of the operation lever can be increased, the arm portion can be shortened. Therefore, miniaturization can be realized.

(2) Preferably, the speed-reduction member is in the form of a single plate, and the large-diameter gear and the small-diameter gear are disposed at the same position in the axial direction of the rotation center shaft. According to this configuration, the speed-reduction member can be reduced in size in the axial direction of the rotation center shaft.

(3) Preferably, the rotation center shaft and a support shaft of the speed-reduction member are arranged at positions different in a moving direction of the slider. According to this configuration, miniaturization can be realized in the connecting direction to the mating connector as compared to the case where the rotation center shaft and the support shaft of the speed-reduction member are arranged side by side in the connecting direction to the mating connector.

(4) Preferably, the housing and the mating connector are connected by rotating the operation lever from an initial position to a connection position, and an extending end part of the arm portion is located on a side opposite to the rotation center shaft across the support shaft in the moving direction of the slider with the operation lever located at the connection position. According to this configuration, miniaturization can be preferably realized in the moving direction of the slider as compared to the case where the extending end part of the arm portion is located on a side opposite to the support shaft of the speed-reduction member across the rotation center shaft.

(5) Preferably, the housing includes a housing body connectable to the mating connector and a wire cover for bending a wire drawn out from the housing body, the operation lever is mounted on the housing body, the wire cover is detachably mountable on the housing body, the operation lever and the speed-reduction member are mounted on the wire cover, a cover member having a lever member rotatably mounted thereon is detachably mountable on the housing body, and the lever member is provided with a speed-reduction gear to be meshed with the rack. An assembly obtained by mounting the operation lever and the speed-reduction member on the wire cover has a large number of components and high cost, but is high in boosting performance. In contrast, an assembly obtained by mounting the lever member on the cover member is relatively low in boosting performance, but has a small number of components and the cost thereof can be suppressed. Therefore, the wire cover and the cover member can be selected according to the presence or absence of cost restriction and a necessary boosting function.

Details of Embodiments of Present Disclosure

Embodiment

Hereinafter, one specific embodiment of the present disclosure is described with reference to FIGS. 1 to 6. Note that the present invention is not limited to these illustrations and is intended to be represented by claims and include all changes in the scope of claims and in the meaning and scope of equivalents. In the following description, a left side in FIGS. 1 and 4 to 6 is defined as a front side concerning a front-rear direction. Upper and lower sides shown in FIGS. 1 to 6 are directly defined as upper and lower sides concerning a vertical direction. A front side in FIGS. 1 and 4 to 6 is defined as a left side concerning a lateral direction.

Figure 3:
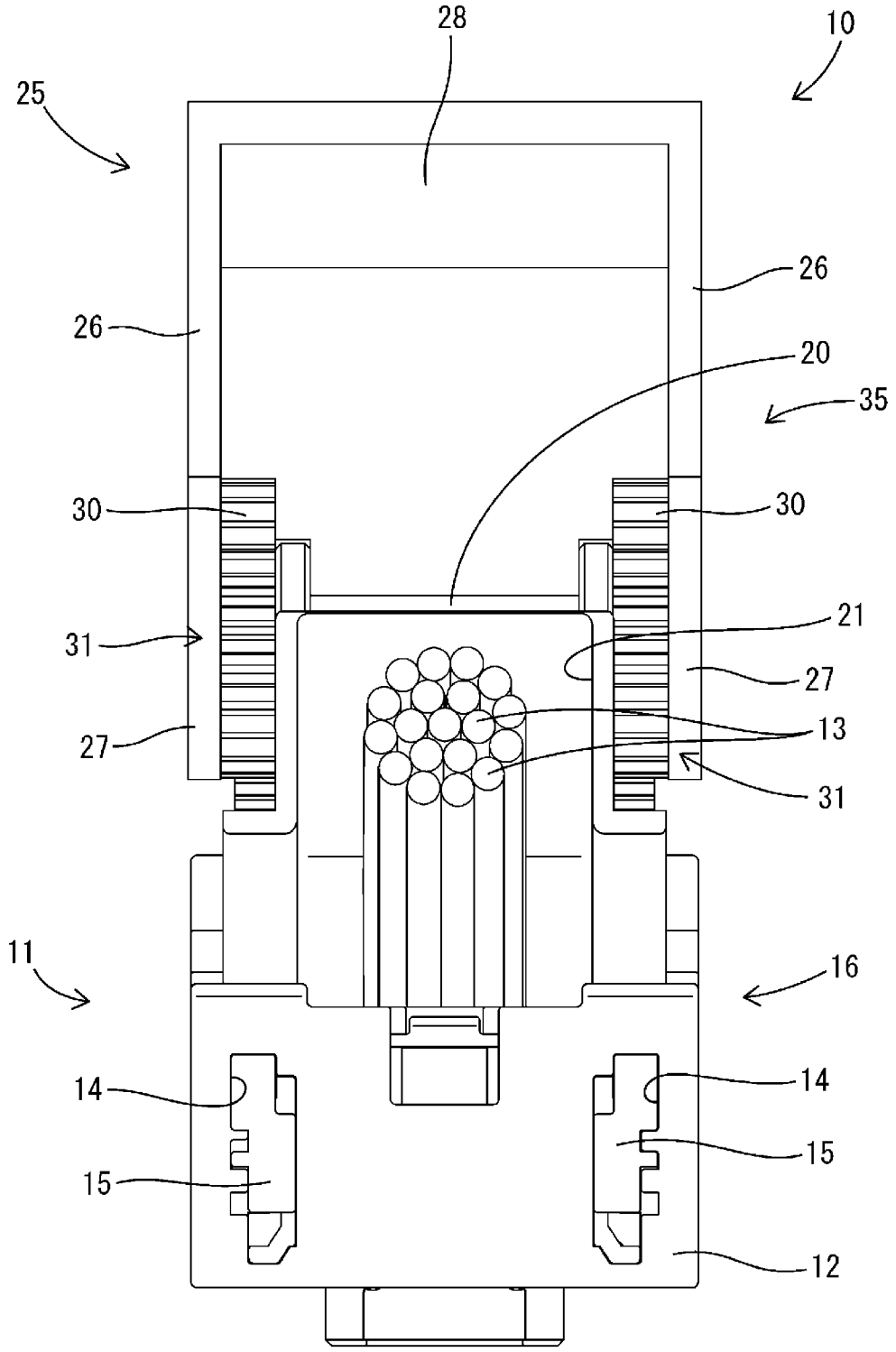
FIG. 3 is a back view of the first connector.
Figure 4:
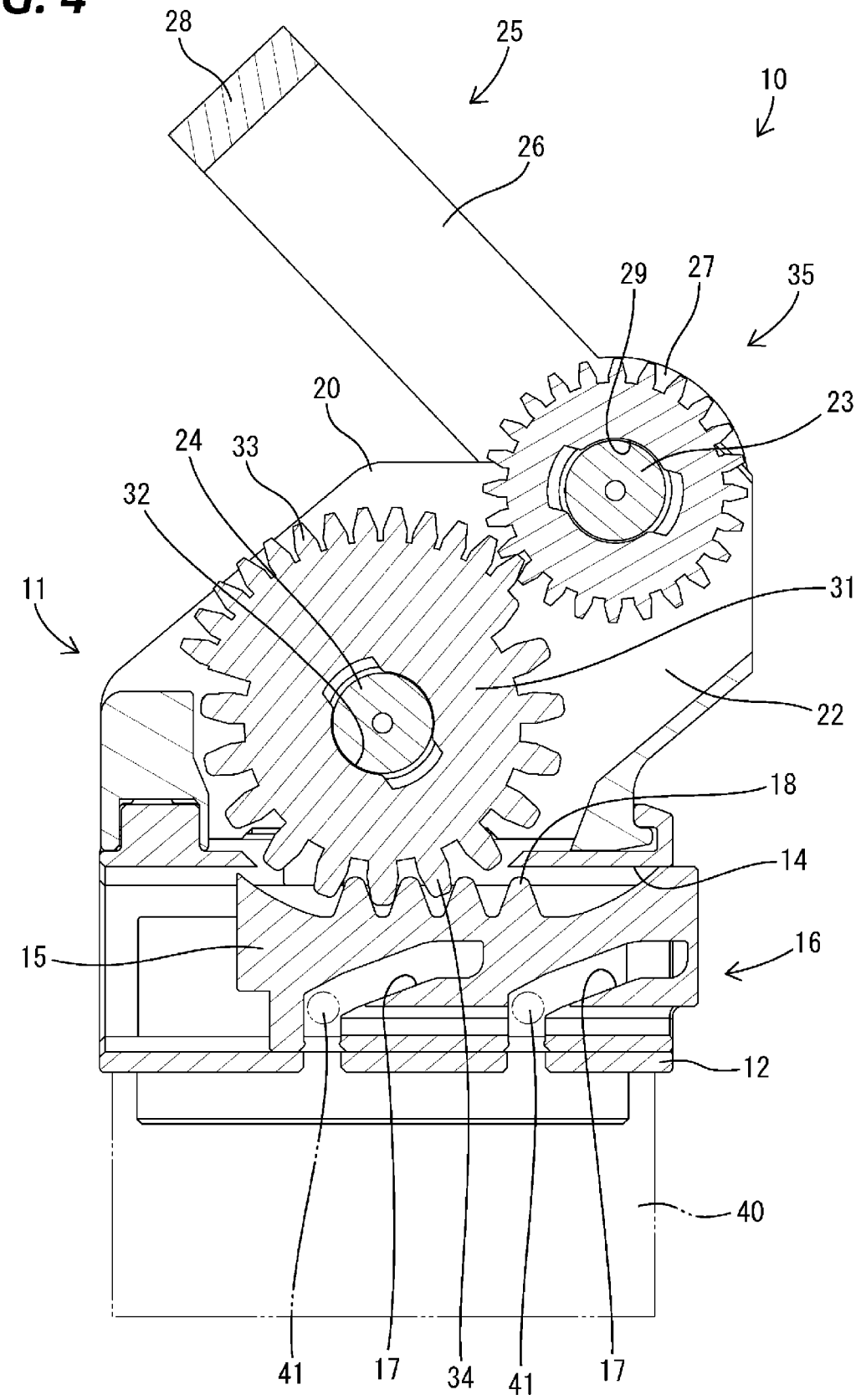
FIG. 4 is a side view in section showing a state where an operation lever is at an initial position.
Figure 5:
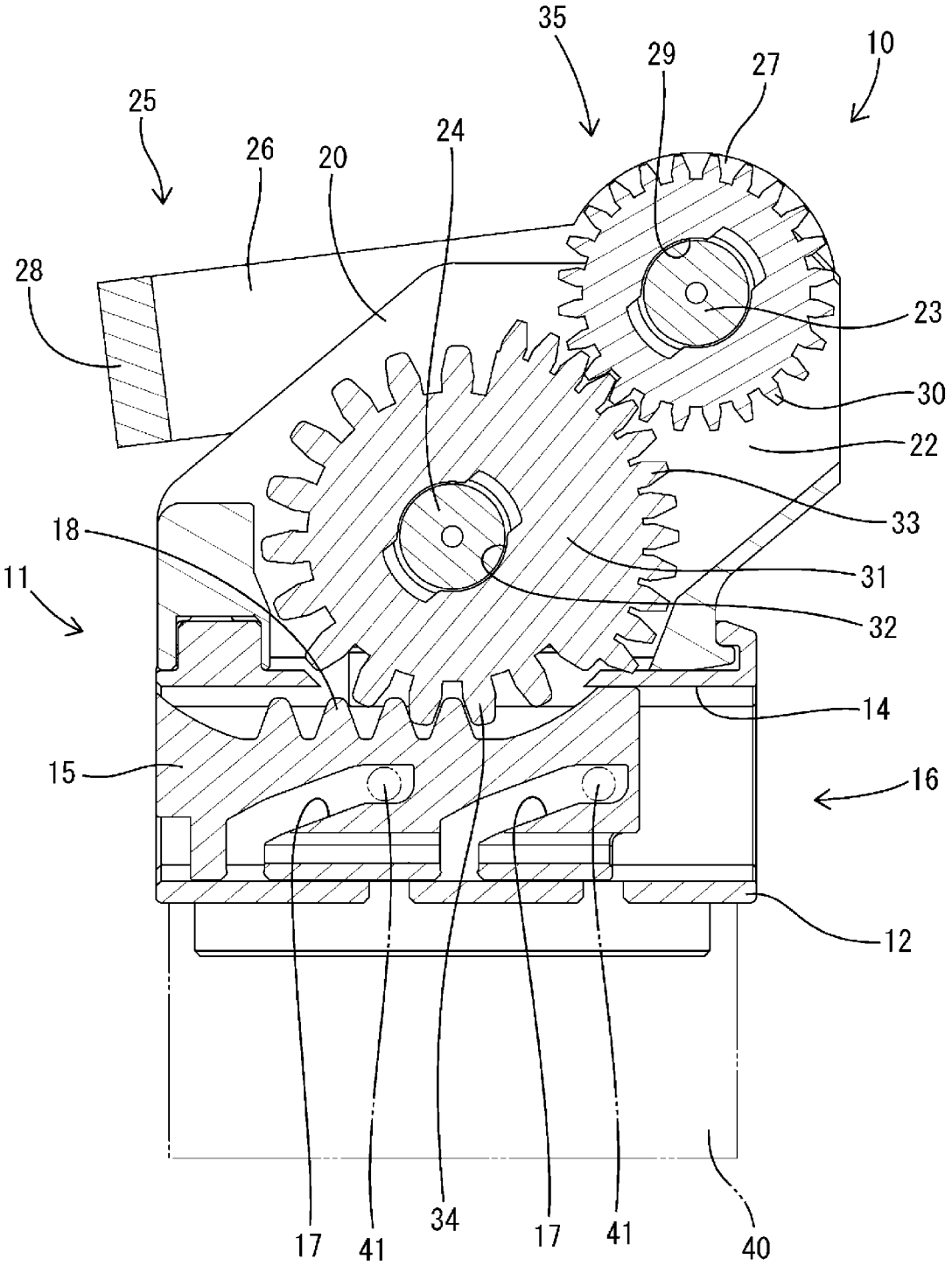
FIG. 5 is a side view in section showing a state where the operation lever is rotated to a connection position.

As shown in FIGS. 4 and 5, a first connector 10 of this embodiment includes a housing 11, sliders 15, an operation lever 25 and speed-reduction members 31. The housing 11 is configured by assembling a housing body 12 and a wire cover 20. A plurality of terminal fittings (not shown) are mounted into the housing body 12. As shown in FIG. 3, wires 13 connected to the respective terminal fittings are drawn out upward to the outside of the housing body 12 from the upper surface (back surface) of the housing body 12.

Figure 2:
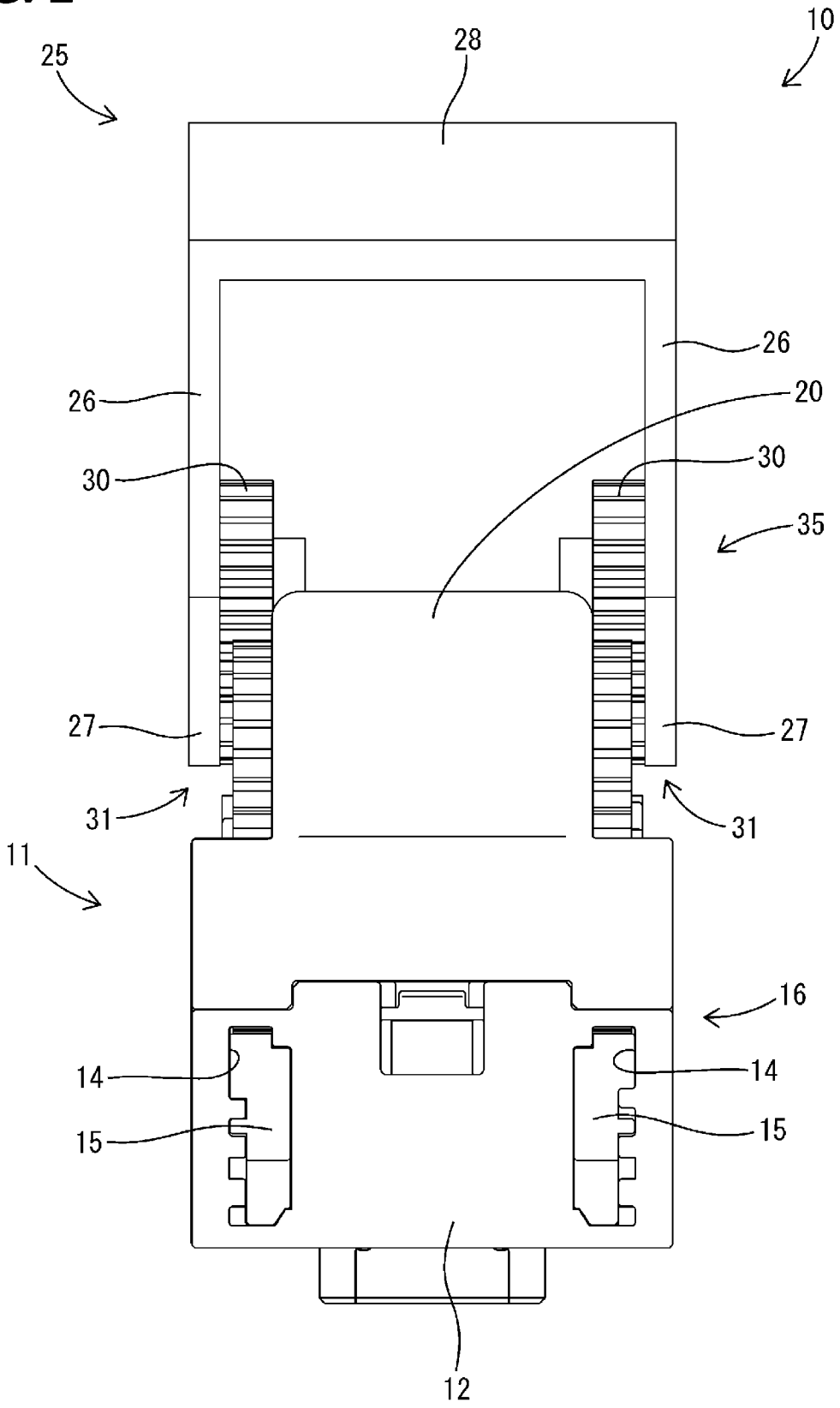
FIG. 2 is a front view of the first connector.

A pair of left and right moving spaces 14 disposed along both left and right side walls of the housing body 12 are formed inside the housing body 12. The moving spaces 14 penetrate through the housing body 12 in the front-rear direction. The moving spaces have a vertically long front view shape as shown in FIGS. 2 and 3. A pair of left and right plate-like sliders 15 are respectively individually so mounted in the pair of left and right moving spaces 14 as to be parallelly movable (slidable) in the front-rear direction. A housing module 16 is configured by assembling the pair of sliders 15 with the housing body 12.

The slider 15 is formed with a pair of front and rear cam grooves 17 oblique to the front-rear direction (direction parallel to a moving direction of the slider 15) and the vertical direction (direction parallel to a connecting direction of the first connector 10 and a second connector 40). The entrances of the cam grooves 17 are open in a lower end edge part of the slider 15. A rack 18 (linear gear) in which a plurality of crest parts and a plurality of trough parts are alternately arranged in the front-rear direction in a side view is formed on an upper edge part of the slider 15.

The wire cover 20 is detachably mountable on the upper surface of the housing body 12. As shown in FIG. 3, the inside of the wire cover 20 serves as a turning space 21. The turning space 21 is open in the lower and rear surfaces of the wire cover 20. The plurality of wires 13 drawn out upward from the housing body 12 are bent rearward in the turning space 21 and substantially horizontally drawn out to a rear-outer side of the wire cover 20.

A pair of left and right side wall portions 22 constituting the wire cover 20 are formed with a pair of left and right coaxial rotation center shafts 23 having axes extending in the lateral direction and a pair of left and right coaxial support shafts 24 having axes extending in the lateral direction (parallel to the rotation center shafts 23). The rotation center shafts 23 and the support shafts 24 project laterally outward (outer surface sides of the wire cover 20).

In a side view of the first connector 10 (wire cover 20) viewed from a direction perpendicular to the front-rear direction and the vertical direction, the rotation center shaft 23 is arranged on a rear end part of the wire cover 20 (side wall portion 22) and an upper end part of the wire cover 20 (side wall portion 22). Similarly, in the side view, the support shaft 24 is disposed in a substantially central part in the front-rear direction of the wire cover 20. Thus, the rotation center shaft 23 and the support shaft 24 are arranged at mutually different positions in the front-rear direction. The rotation center shaft 23 and the support shaft 24 are also arranged at mutually different positions in the vertical direction.

The operation lever 25 is rotatably mounted on the rotation center shafts 23. The operation lever 25 is a single component including a pair of left and right elongated arm portions 26, bearing portions 27 formed on base end parts of the both left and left arm portions 26 and an operating portion 28 coupling tip parts (end parts opposite to the base end parts) of the both left and right arm portions 26. The arm portion 26 is in the form of a flat plate having a plate thickness direction aligned with the lateral direction (direction parallel to an axis of the rotation center shaft 23). The bearing portion 27 of the arm portion 26 is formed with a bearing hole 29.

The operation lever 25 is rotatable by a predetermined angle (e.g. 60°) between an initial position (see FIGS. 1 to 4) and a connection position (see FIG. 5) about the rotation center shafts 23 as a lateral center by fitting the bearing holes 29 to the rotation center shafts 23. With the operation lever 25 located at the initial position, the arm portions 26 are cantilevered radially outward from the rotation center shafts 23. An extending direction of the arm portions 26 is an oblique direction from the rotation center shafts 23 to a front-upper side. With the operation lever 25 located at the connection position, the arm portions 26 are substantially horizontal and the extending direction of the arm portions 26 from the rotation center shafts 23 is a forward direction.

The bearing portion 27 is integrally formed with a circular drive gear 30. A pitch circle of the drive gear 30 is coaxial with the rotation center shaft 23. The drive gear 30 projects in an axial direction of the rotation center shaft 23 from the inner surface of the bearing portion 27. In other words, the arm portion 26 (bearing portion 27) and the drive gear 30 are shifted in position and adjacent in the axial direction of the rotation center shaft 23.

An outer diameter of the drive gear 30 is set to be equal to that of the bearing portion 27. A pitch diameter (radius) of the drive gear 30 is set to be sufficiently smaller than a length from an axis center of the rotation center shaft 23 to the operating portion 28. By this dimensional difference, a rotational operation force (rotation torque) applied to the arm portion 26 is translated into an increased rotational operation force in the drive gear 30.

The speed-reduction member 31 is rotatably mounted on the support shaft 24. The speed-reduction member 31 is in the form of a flat plate having a plate thickness direction aligned with the lateral direction (direction parallel to an axis of the support shaft 24). The speed-reduction member 31 is formed with a shaft hole 32 fittable to the support shaft 24. The speed-reduction member 31 is rotatable about the support shaft 24 by fitting the shaft hole 32 to the support shaft 24.

A large-diameter gear 33 and a small-diameter gear 34 are formed on the outer periphery of the speed-reduction member 31. The large-diameter gear 33 is formed over a substantially ⅓ region of the outer periphery of the speed-reduction member 31. A pitch circle of the large-diameter gear 33 is concentric with the support shaft 24 and a pitch diameter of the large-diameter gear 33 is set to be larger than that of the drive gear 30.

The speed-reduction member 31 is so arranged that the large-diameter gear 33 is at the same position as the drive gear 30 in the axial directions of the rotation center shaft 23 and the support shaft 24. The sum of the pitch radius of the drive gear 30 and the pitch radius of the large-diameter gear 33 are equal to a distance between an axis center of the rotation center shaft 23 and that of the support shaft 24. In this way, the large-diameter gear 33 and the drive gear 30 are meshed.

The small-diameter gear 34 is formed in a region where the large-diameter gear 33 is not formed, out of the outer periphery of the speed-reduction member 31, i.e. over a substantially ⅔ region of the outer periphery of the speed-reduction member 31. A pitch circle of the small-diameter gear 34 is concentric with the support shaft 24 and the large-diameter gear 33, and a pitch diameter of the small-diameter gear 34 is set to be larger than that of the drive gear 30 and smaller than that of the large-diameter gear 33. By this dimensional difference, a rotational operation force (rotation torque) applied to the large-diameter gear 33 is translated into an increased rotational operation force in the small-diameter gear 34.

The small-diameter gear 34 is arranged at the same position as the drive gear 30 and the large-diameter gear 33 in the axial directions of the rotation center shaft 23 and the support shaft 24. A speed-reduction module 35 is configured by assembling the operation lever 25 and the speed-reduction members 31 with the wire cover 20. If the speed-reduction module 35 (wire cover 20) is assembled with the housing body 12, the small-diameter gears 34 are meshed with the racks 18 of the sliders 15. The small-diameter gears 34 and the racks 18 are arranged at the same positions in the axial directions of the rotation center shafts 23 and the support shafts 24.

The first connector 10 assembled as described above is connected to the second connector 40 from above. A pair of front and rear cam followers 41 in the form of projections are formed on each of both left and right side surface parts of the second connector 40. If the first connector 10 and the second connector 40 are lightly fit with the operation lever 25 held at the initial position, the cam followers 41 enter the entrances of the cam grooves 17. If the operation lever 25 at the initial position is rotated to the connection position from this state, the connection of the both connectors 10, 40 proceeds by the sliding contact of the cam grooves 17 and the cam followers 41. If the operation lever 25 reaches the connection position, the both connectors 10, 40 are properly connected.

While the operation lever 25 is being rotated, a rotational operation force applied to the operation lever 25 is transmitted as an increased rotation force to the speed-reduction members 31 by the mesh of the drive gears 30 and the large-diameter gears 33. The rotation force transmitted to the speed-reduction members 31 is further increased by the pitch diameter difference between the large-diameter gears 33 and the small-diameter gears 34 in the speed-reduction members 31. This increased rotation force is transmitted to the sliders 15 via the mesh of the small-diameter gears 34 and the racks 18. In this way, even if an operation force applied to the operation lever 25 is small, the sliders 15 can be slid with a large force.

Further, in separating the both connectors 10, 40 in the connected state, the operation lever 25 at the connection position is rotated to the initial position. During this time, the both connectors 10, 40 are relatively displaced away from each other by the sliding contact of the cam grooves 17 and the cam followers 41. If the operation lever 25 reaches the initial position, the both connectors 10, 40 become separable. Also in the process of rotating the operation lever 25 from the connection position to the initial position, a rotational operation force applied to the operation lever 25 is increased and transmitted to the sliders 15 as at the time of the connecting operation, wherefore the sliders 15 can be slid with a large force even if an operation force applied to the operation lever 25 is small.

As described above, the first connector 10 of this embodiment includes the housing 11, the operation lever 25, the speed-reduction members 31 and the sliders 15. The operation lever 25 includes the arm portions 26 radially extending from the rotation center shafts 23 and is rotatably mounted on the housing 11. The drive gears 30 are integrally rotatably provided on the operation lever 25. The drive gears 30 are coaxial with the rotation center shafts 23 and disposed at positions different from the arm portions 26 in the axial direction of the rotation center shafts 23.

The speed-reduction members 31 are rotatably mounted on the housing 11. The speed-reduction member 31 includes the large-diameter gear 33 to be meshed with the drive gear 30 and the small-diameter gear 34 disposed coaxially with the large-diameter gear 33 and having a smaller diameter than the large-diameter gear 33. The slider 15 includes the cam grooves 17 and the rack 18 to be meshed with the small-diameter gear 34. The slider 15 is mounted in the housing 11 movably in the front-rear direction intersecting the connecting direction to the second connector 40.

Since the arm portions 26 of the operation lever 25 and the large-diameter gears 33 of the speed-reduction members 31 are shifted in position from each other in the axial direction of the rotation center shafts 23 of the operation lever 25, there is no possibility that the arm portions 26 interfere with the large-diameter gears 33 even if an angle of rotation of the operation lever 25 is increased. Thus, a large angle of rotation of the operation lever 25 (arm portions 26) can be ensured. In this way, even if the pitch diameters of the drive gears 30 are reduced, an angle of rotation of the speed-reduction members 31 necessary to connect/separate the both connectors 10, 40 can be ensured by sliding the racks 18 a predetermined length.

Since the pitch diameters of the drive gears 30 can be reduced in the first connector 10 of this embodiment as just described, a torque applied to the operation lever 25 during a rotating operation can be small. If the torque applied to the operation lever 25 can be small, the lengths of the arm portions 26 can be shortened. Thus, the first connector 10 can be miniaturized.

Further, the speed-reduction member 31 is in the form of a single plate and the large-diameter gear 33 and the small-diameter gear 34 are disposed at the same position in the axial directions of the rotation center shaft 23 and the support shaft 24. According to this configuration, the speed-reduction member 31 can be reduced in size (thinned) in the axial directions of the rotation center shaft 23 and the support shaft 24.

Further, the rotation center shafts 23 of the operation lever 25 and the support shafts 24 of the speed-reduction members 31 are arranged at the mutually different positions in the moving direction of the sliders 15 (front-rear direction). According to this configuration, the both connectors 10, 40 can be miniaturized in the connecting direction of the both connectors 10, 40 as compared to the case where the rotation center shafts 23 and the support shafts 24 are arranged side by side in the connecting direction (vertical direction) of the both connectors 10, 40.

Further, by rotating the operation lever 25 from the initial position to the connection position, the first connector 10 (housing 11) and the second connector 40 are connected. With the operation lever 25 located at the connection position, extending end parts (operating portion 28) of the arm portions 26 are located on a side opposite to the rotation center shafts 23 across the support shafts 24 in the moving direction (front-rear direction) of the sliders 15. According to this configuration, miniaturization in the moving direction (front-rear direction) of the sliders 15 is possible as compared to the case where the extending end parts (operating portion 28) of the arm portions 26 are located on a side opposite to the support shafts 24 of the speed-reduction members 31 across the rotation center shafts 23 when the operation lever 25 is at the connection position.

Further, the housing 11 of the first connector 10 includes the housing body 12 connectable to the second connector 40 and having the operation lever 25 mounted thereon, and the wire cover 20 detachably mountable on the housing body 12. The wire cover 20 has a function of bending the wires 13 drawn out from the housing body 12. The operation lever 25 and the speed-reduction members 31 are mounted on the wire cover 20, thereby configuring the speed-reduction module 35.

Figure 6:
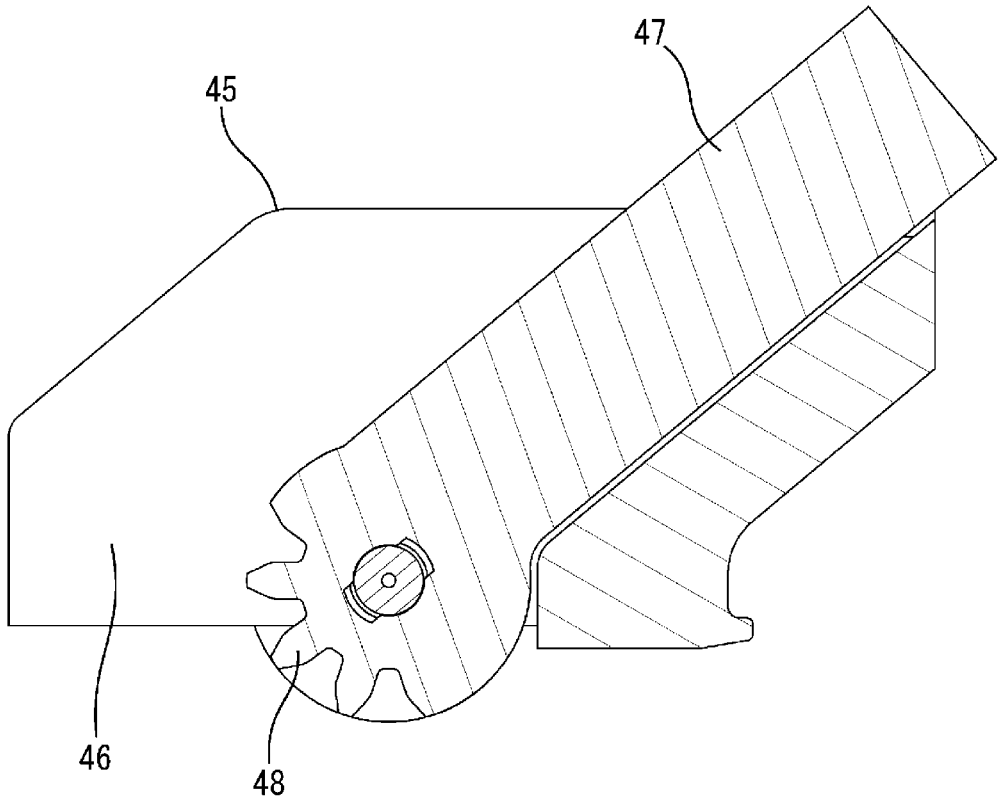
FIG. 6 is a side view in section showing a state where a lever member is mounted on a cover member.

The wire cover 20 (speed-reduction module 35) can be mounted on and detached from the housing body 12, and a cover member 45 is mountable on the housing body 12 having the wire cover 20 detached therefrom. The cover member 45 can be mounted on and detached from the housing body 12. As shown in FIG. 6, the cover member 45 has a function of turning the wires 13 drawn out from the housing body 12 rearward, similarly to the wire cover 20. A lever member 47 is rotatably mounted on both left and right side plate portions 46 constituting the cover member 45. The lever member 47 is integrally provided with speed-reduction gears 48 to be meshed with the racks 18.

An assembly (speed-reduction module 35) obtained by mounting the operation lever 25 and the speed-reduction members 31 on the wire cover 20 has a large number of components and high cost, but is high in boosting performance. In contrast, an assembly obtained by mounting the lever member 47 on the cover member 45 is relatively lower in boosting performance than the speed-reduction module 35, but has a smaller number of components than the speed-reduction module 35 and the cost thereof can be suppressed. Therefore, the wire cover 20 and the cover member 45 can be selected according to the presence or absence of cost restriction and a necessary boosting function.

Other Embodiments

The present invention is not limited to the above described and illustrated embodiment, but is represented by claims. The present invention is intended to include all changes in the meaning of equivalents to claims and in the scope of claims and also include the following embodiments.

Although the drive gears are integrally formed on the operation lever in the above embodiment, the drive gears may be components separate from the operation lever and assembled with the operation lever.

Although the large-diameter gear and the small-diameter gear are disposed at the same position in the axial direction of the rotation center shaft in the above embodiment, the large-diameter gear and the small-diameter gear may be disposed at positions different in the axial direction of the rotation center shaft.

Although the rotation center shaft and the support shaft of the speed-reduction member are arranged at the positions different in the moving direction of the slider in the above embodiment, the rotation center shaft and the axis center of the speed-reduction member may be arranged side by side in the connecting direction to the mating connector.

Although the extending end parts of the arm portions are located on the side opposite to the rotation center shafts across the support shafts with the operation lever located at the connection position in the above embodiment, the extending end parts of the arm portions may be located on a side opposite to the support shafts of the speed-reduction members across the rotation center shafts when the operation lever is at the connection position.

Although the wire cover and the cover member can be selectively mounted on the housing body in the above embodiment, only the wire cover may be mountable on the housing body.

LIST OF REFERENCE NUMERALS

10 first connector (connector with booster mechanism)
11 housing
12 housing body
13 wire
14 moving space
15 slider
16 housing module
17 cam groove
18 rack
20 wire cover
21 turning space
22 side wall portion
23 rotation center shaft
24 support shaft
25 operation lever
26 arm portion
27 bearing portion
28 operating portion
29 bearing hole
30 drive gear
31 speed-reduction member
32 shaft hole
33 large-diameter gear
34 small-diameter gear
35 speed-reduction module
40 second connector (mating connector)
41 cam follower
45 cover member
46 left and right side plate portions
47 lever member
48 speed-reduction gear

What is claimed is:

1. A connector with booster mechanism, comprising:

a housing;

an operation lever rotatably mounted on the housing, the operation lever including an arm portion radially extending from a rotation center shaft;

a drive gear integrally rotatably provided on the operation lever;

a speed-reduction member rotatably mounted on the housing; and a slider, wherein:

the drive gear is coaxial with the rotation center shaft and disposed at a position different from the arm portion in an axial direction of the rotation center shaft, the speed-reduction member includes a large-diameter gear to be meshed with the drive gear and a small-diameter gear having a smaller diameter than the large-diameter gear and disposed coaxially with the large-diameter gear, and the slider includes a cam groove and a rack to be meshed with the small-diameter gear and is mounted on the housing movably in a direction intersecting a connecting direction to a mating connector.

2. The connector with booster mechanism of claim 1, wherein:

the speed-reduction member is in the form of a single plate, and the large-diameter gear and the small-diameter gear are disposed at the same position in the axial direction of the rotation center shaft.

3. The connector with booster mechanism of claim 1, wherein the rotation center shaft and a support shaft of the speed-reduction member are arranged at positions different in a moving direction of the slider.

4. The connector with booster mechanism of claim 3, wherein:

the housing and the mating connector are connected by rotating the operation lever from an initial position to a connection position, and an extending end part of the arm portion is located on a side opposite to the rotation center shaft across the support shaft in the moving direction of the slider with the operation lever located at the connection position.

5. The connector with booster mechanism of claim 1, wherein:

the housing includes a housing body connectable to the mating connector and a wire cover for bending a wire drawn out from the housing body, the operation lever is mounted on the housing body, the wire cover is detachably mountable on the housing body, the operation lever and the speed-reduction member are mounted on the wire cover, a cover member having a lever member rotatably mounted thereon is detachably mountable on the housing body, and the lever member is provided with a speed-reduction gear to be meshed with the rack.

* * * * *